United States Patent [19]

Honjo et al.

[11] 4,049,448

[45] Sept. 20, 1977

[54] PROCESS FOR PRODUCING AN ELECTROPHOTOGRAPHIC MATERIAL IN WHICH A PINHOLE-FILLING DISPERSION IS EMPLOYED

[75] Inventors: Satoru Honjo; Masaaki Takimoto, both of Asaka, Japan

[73] Assignee: Fuji Photo Film Co., Ltd., Minami-ashigara, Japan

[21] Appl. No.: 594,176

[22] Filed: July 8, 1975

Related U.S. Application Data

[63] Continuation-in-part of Ser. No. 368,789, June 11, 1973, Pat. No. 3,911,170.

[30] Foreign Application Priority Data

June 9, 1972 Japan ..... 47-57398

[51] Int. Cl.[2] ..... G03G 5/00

[52] U.S. Cl. ..... 96/1.5 R; 96/1.8

[58] Field of Search ..... 96/1.5, 1.8

[56] References Cited

U.S. PATENT DOCUMENTS

| | | | |
|---|---|---|---|
| 2,534,650 | 12/1950 | Worthen | 96/33 X |
| 2,693,145 | 11/1954 | Mullen | 96/33 X |
| 2,983,220 | 5/1961 | Dalton et al. | 96/1.8 |
| 3,157,117 | 11/1964 | Ralph et al. | 427/411 X |
| 3,165,423 | 1/1965 | Caldwell et al. | 427/390 E X |
| 3,238,056 | 3/1966 | Pall et al. | 427/244 X |
| 3,293,115 | 12/1966 | Lucken | 162/184 |
| 3,298,831 | 1/1967 | Lau et al. | 96/1.8 X |
| 3,468,660 | 9/1969 | Davenport et al. | 96/1.8 X |
| 3,607,255 | 9/1971 | Back | 96/1.8 X |
| 3,615,420 | 10/1971 | Deutsch | 96/1.8 |
| 3,639,122 | 2/1972 | Shimizu et al. | 96/1.8 |
| 3,652,268 | 3/1972 | Rowe | 96/1.5 |
| 3,652,271 | 3/1972 | Bornarth et al. | 96/1.8 |
| 3,656,949 | 6/1969 | Honjo et al. | 96/1.5 |
| 3,672,982 | 6/1972 | Travers | 117/201 |
| 3,672,988 | 6/1972 | Tamai et al. | 117/215 |
| 3,682,629 | 8/1972 | Shimizu et al. | 96/1.8 X |
| 3,682,676 | 8/1972 | Karrh et al. | 117/16 |
| 3,740,217 | 6/1973 | Gramza et al. | 96/1.8 X |
| 3,743,537 | 7/1973 | Honjo et al. | 96/1.8 |
| 3,761,259 | 9/1973 | Arai et al. | 96/1.8 |
| 3,847,661 | 11/1974 | Hill et al. | 96/1.8 X |
| 3,864,128 | 2/1975 | Van Paesschen et al. | 96/1.8 |
| 3,911,170 | 10/1975 | Honjo et al. | 427/140 |

*Primary Examiner*—David Klein
*Assistant Examiner*—John R. Miller
*Attorney, Agent, or Firm*—Sughrue, Rothwell, Mion, Zinn and Macpeak

[57] ABSTRACT

In a process for producingan electrophotographic light-sensitive material having a porous support such as a paper support and at least one film forming resin layer directly coated on the support, the at least one resin layer is processed with a pinhole-filling dispersion comprising a liquid and a finely dispersed substance such as a pigment, a plastic particle or a pigment coated with a plastic therein, whereby the finely dispersed substance fills and seals pinholes in the film forming resin layer.

21 Claims, No Drawings

PROCESS FOR PRODUCING AN ELECTROPHOTOGRAPHIC MATERIAL IN WHICH A PINHOLE-FILLING DISPERSION IS EMPLOYED

This application is a continuation-in-part of Ser. No. 368,789, filed June 11, 1973, now U.S. Pat. No. 3,911,170.

1. Field of the Invention

The present invention relates to an improved process for producing an electrophotographic material, more particularly, to a process for producing an electrophotographic material having at least one film-forming resin layer free of pinholes.

2. Description of the Prior Art

Electrophotographic light-sensitive materials comprising a support, such as paper, having provided thereon a zinc oxide/resin dispersion type photoconductive insulating layer or an organic photoconductive layer mainly comprising polyvinyl carbazole, are widely used in the copying field.

However, when a so-called liquid developing method is used to develop such materials, the following problems are encountered. In many cases, the back surface or surface free of a light-sensitive layer of such a material is also provided with a resin layer, and fine pinholes unavoidably lie scattered throughout the layer. A liquid developer is liable to penetrate through these pinholes into the interior of the paper support, resulting in the formation of undesirable spot-like stains on the back side of a finished print, as well as increasing the drying load and consumption of developer.

When the back surface is not coated in any manner to permit the free penetration (absorption) of liquid over the whole surface and the processing solution is squeezed at the end of processing followed by forced drying, stains are uniformly formed over the whole surface since the liquid is freely volatized from the paper, and hence there are comparatively less problems regarding the drying load and the wastage rate of the liquid.

However, where a film capable of preventing a liquid from penetrating into a light-sensitive material to a considerable degree is provided, the liquid is difficult to volatize once it penetrates into the light-sensitive material, which results in spot-like, non-dryable regions which remain over a long period of time.

As one solution to these problems, methods of reducing the number of pinholes have been suggested, e.g., making a film thick to such an extent that almost no liquid penetration is observed during processing with a liquid, and conducting processing in two steps wherein the back surface is first processed with a carrier liquid for a developing agent to penetrate a colorless, toner-free liquid into the support.

The former method, however, is economically disadvantageous since the film must be thick. For example, in order to try to attain the above-described object, resins such as polyvinyl alcohol must be applied in an amount of about 5 g/m$^2$ to the back side of the light-sensitive material. This seriously affects the mechanical properties of the resulting paper and imposes additional restrictions on the processing of the opposite surface from the point of curling balance or the like, as well as lowering the flexibility and feel which is characteristic of paper. Thus, the application of a resin film in such an amount is not preferred. In addition, even at such a coating amount, resins capable of constituting a closed layer are restricted as to kind, which seriously narrows the degree of freedom in setting up production conditions.

The latter method involves the defects that it requires complicated apparatus since the processing is conducted in two steps and that non-dryable spots remain as in the first method, though no stains are left after drying since the penetrating liquid contains no toner. These non-dryable spots cause problems in the case of, e.g., obtaining color images and the like by a superposition development.

Further, when a photoconductive-pigment layer coating dispersion is coated on a resin coated porous support, the dispersion penetrates into the resin layer through pinholes in the resin layer, and after drying many hillocks are observed on the coated surface. The hillocks are produced by deposition of photoconductive particles at the pinholes, the particles piling up after the resin contained in the dispersion penetrates into the support. The image quality obtained using such an electrophotographic material is very poor due to the rough surface, i.e., optical density is low and fogging is significant.

SUMMARY OF THE INVENTION

One object of the present invention is to provide a method for removing pinholes in a film-forming resin layer coated on a porous support of an electrophotographic material.

Another object of the present invention is to provide a process for producing an electrophotographic material by which excellent image quality, that is, an image without the aforesaid defects, can be obtained.

The objects of the present invention can be attained by the following method:

In a process for producing an electrophotographic light-sensitive material having a porous support and at least one film-forming resin layer directly coated on the support, the layer is brought into contact with a pinhole-filling dispersion comprising a liquid and a finely dispersed substance selected from the group consisting of a colorless pigment, a plastic particle or a pigment coated with a plastic, the liquid easily penetrating into the interior of the porous material through pinholes in the film-forming resin layer and carrying the finely dispersed substance into the pinholes, whereby the finely dispersed substance fills and seals the pinholes which permit the penetration of liquid and which exist in the surface of the film-forming resin layer which is capable of nearly completely preventing penetration of a liquid to the porous support.

The finely dispersed substance has a diameter less than or approximately the same as that of the pinholes and is capable of stopping up the pinholes.

The pinhole-filling dispersion penetrates into the interior of the support material through the pinholes, and the finely dispersed particles agglomerate at the pinholes to prevent the further penetration of the liquid.

DETAILED DESCRIPTION OF THE INVENTION

The present invention will now be moe specifically described.

The film-forming resin layer can be provide (hereinafter referred to as "step (a)") can be accomplished by various techniques so far known. Step (a) does not constitute an essential concept of the invention. As a typical example, there is illustrated applying a resin solution or a resin dispersion to a base material such as paper. Resins possess a film-forming property and form an approximately continuous film on the surface of the base material. Of course, there remain microscopically discontinuous portions on the surface, which portions form pinholes.

The type of element with which the present invention finds particular application can be described with reference to the analysis method described in TAPPI, Volume 48, No. 10, page 97 A middle and right columns. Pinholes, or penetration points, can be classified into various degrees. A great number of pinholes is more than 20 penetration points/cm$^2$. An intermediate level is from 5 to 19 penetration points/cm$^2$. A very low level of penetration points is less than 5, preferably less than 4, per cm$^2$.

In the present invention, coated porous materials which have more than 20 penetration points per cm$^2$ are particularly amenable to the penetration problem discussed. Using the pinhole/filling dispersion of this invention, the number of penetration points can be lowered to less than 4 penetration points/cm$^2$. Thus, assuming 5 to 30 penetration points/cm$^2$, the pinhole filling dispersion of the present invention can reduce the number of penetration points per cm$^2$ to less than 4, and offers excellent affects when the number of pinholes prior to treatment is from 5 to 25 per cm$^2$.

As will be understood from the context of the present invention, the term "pinhole" refers to any small hole through which a solution can penetrate. For most practical purposes, layers which are subject to pinholing (and yet which are commercially used in the industry), have pinholes of a size less than about 10 microns.

Though holes of this size, the pinhole filling dispersion (or the penetration of the dispersion which is to be prevented) rapidly penetrates initially, for instance, at an penetration rate of about $2 \times 10^{-4}$mm$^3$ to about $60 \times 10^{-4}$mm$^3$ per second, more commonly from $4 \times 10^{-4}$ to $32 \times 10^{-4}$mm$^3$/sec. After treatment, the rate of penetration is less than 1/5 such a penetration rate.

It will be understood from the above that the film-forming resin of the present invention is not limited to any special manner, and most common resins used to surface coat porous materials are polyalkyl acrylates, methacrylates, alkylacrylates, alkyl methacrylates, copolymers thereof with compatible materials (where any alkyl group in the preceding materials preferably has 1–4 carbon atoms), polystyrene, polyvinyl acetate, linear polyesters unsaturated polyesters, alkyd epoxy resins, polyvinyl alcohol, polyvinylbenzyl trimethyl ammonium chloride, copolymers of styrene and butadiene, film-forming electroconductive resins, for example, poly(N,N-dimethyl-3,5-methylene piperidinium chloride), poly(vinylbenzyl-trimethylammonium chloride) and those set forth in U.S. Pat. Nos. 3,486,932, 3,544,318, 3,011,918, film-forming photoconductive resins, for example, polyvinyl carbozol, polyvinylpyrene and those set forth in U.S. Pat. Nos. 3,162,532, 3,037,861, British Pat. No. 964,871, and a mixture of a low-molecular weight photoconductive compound, for example, oxadiazoles (U.S. Pat. No. 3,189,447), thiadiazoles (British Pat. No. 1,004,927), triazoles (U.S. Pat. No. 3,112,197), imidazoles (U.S. Pat. No. 3,097,095), oxazoles (British Pat. No. 873,634), thiazoles (British Pat. No. 1,008,631) and imidazoles (British Pat. No. 938,434), with a polymer binder. It will be apparent to one skilled in the art that it is completely impossible to list every conceivable resin which could be used as a surface-coating material, and the above listing shall only be taken as representative.

As the porous support of the present invention any material which can be surface coated with a film-forming resin layer can be used. For example, paper, cloth, wood and a porous plastic material such as non-woven fabrics and woven fabrics, etc. can be used.

The second step (hereinafter referred to as step (b)) constitutes the basis of the invention. As the processing dispersion those which meet the following requirements suffice:

i. No detrimental influence is exerted on the base material.

ii). The dispersion medium of the processing dispersion is volatile, or highly soluble in a volatile solvent for the medium.

The "carrier liquid" for the finally dispersed pinhole-filling particles is best an easily volatilized petroleum hydrocarbon solvent, an ester, ketone, alcohol, halogenated hydrocarbon or the like. As will be appreciated by one skilled in the art, it is important that the carrier liquid not attack the coating layer since, essentially, one would then be enlarging the pinholes. High volatility is useful because this can be used as one procedure for the coagulation of the finely dispersed pinhole-filling material.

Specific examples of such materials are petroleum hydrocarbons such as kerosene, hexane, heptane, cyclohexane, benzene, toluene, xylene, isoparaffins and ligroin; esters such as carboxilic acid alkyl esters where the carboxylic acid and alkyl group having from 1 to 4 carbon atoms such as methyl acetate, ethyl acetate, butyl acetate, ethyl lactate and butyl lactate; ketones such as acetone, methyl ethyl ketone and methyl isobutyl ketone; alcohols having from 1 to 3 carbon atoms, such as methanol, ethanol and propanol; halogenated hydrocarbons such as methylene chloride, ethylene chloride, trichloroethylene, tetrachloroethane, carbon tetrachloride and chloroform; mixture thereof and the like.

A non-volatile medium can also be used. In this case, the surface of the support processed with the dispersion(s) should be treated with a volatile solvent in which the medium is highly soluble. The medium liquid which has penetrated into the support or the resin layer should thus be substituted for by the volatile solvent.

The material which is finally dispersed in the carrier liquid to serve as a pinhole-filling or clogging material is not especially limited. However, practically speaking, useful materials will comprise colorless pigments, plastic particles, and plastic coated pigments particles, which are able to coagulate in the pinholes and fill the same.

Preferred plastic particles are thermoplastic resins having a molecular weight of from about 10,000 to about 200,000 such as polyvinyl chloride, vinyl chloride-vinyl acetate copolymers, styrene butadiene copolymers, polyacrylic acid-alkyl esters (ester moiety having from 1 ro 4 carbon atoms), polymethacrylic acid alkyl esters (ester moiety having from 1 to 4 carbon atoms), copolymers of such esters and vinyl chloride, styrene, acrylic acid or crotonic acid, or mixtures thereof and the like.

Preferred colorless pigments are pigments such as titanium oxide, zinc oxide, magnesium oxide, aluminum oxide, silicon dioxide, aluminum hydroxide, calcium hydroxide, calcium silicate, potassium silicate, mixtures thereof and the like.

Preferred plastic coated pigments are the above pigments coated with the above plastics.

While not especially limited, the finally dispersed material should comprise from about 1 to about 20% by volume of the carrier liquid, more preferably 1 to 5% of the carrier liquid. This permits a good transportation rate of the finely dispersed material into the pinholes.

From the above discussion it will be apparent that the size of the finally dispersed particles in the carrier liquid can vary greatly but, however, cannot be greater than the pinhole diameter. Generally speaking, as size increase much above 10 microns the pinhole-filling effect tends to fall off, with the same tendency being seen with particles below about 0.1 micron. Considering both of these factors, it is thus most preferred to use finally dispersed particles which have a size of 0.5 microns to 5 microns.

The electrophotographic material obtained by the process of the present invention can be subjected to either dry or wet developing treatments. Treatment with the processing dispersion can be applied to any resin coated surface on the porous support. For example, it may be a resin coated layer on the back surface of a support of an electrophotographic material which is subjected to a wet developing process; an electroconductive or photoconductive resin layer on the support of the electrophotographic material which is subjected either to the dry or wet developing process; or resin coated layers on both sides of the support of an electrophotographic material which is subjected to a wet developing process.

The present invention will now be explained taking, for instance, the processing of the back surface of a support for use in electrophotography.

Assuming the surface of the base material to be the support, which is the surface on which there is to be provided, a light-electrophotoconductive layer, is not yet processed, a resin layer is provided on the other surface or back side thereof.

As a processing dispersion, a dispersion prepared by dispersing fine particles of a thermoplastic resin in a petroleum solvent is utilized. This dispersion is brought into contact with the back side surface for a sufficient period of time, for instance, on the order of 2 seconds to 40 seconds, more generally contact for about 5 to 20 seconds being sufficient. Thereafter, rollers, followed by drying. Before squeezing, the treated surface may be washed with pure liquid which is used as the medium or another volatile liquid such as kerosene or cyclohexane. Prior to drying, the liquid of the dispersion penetrates into the squeezed surface through the pinholes. The projected area of the penetrated liquid is usually from about 10 to 20 times to about 100 times that of the pinholes. It has been found that once the thus processed support is dried, the liquid does not penetrate thereinto any more. That is, when the liquid passes through the pinholes the fine particles agglomerate in the pinholes. If a lot of excess liquid is left in a small amount on the film, no trouble is encountered in the following steps and it can be completely removed by air-squeezing or the like.

The time of drying and the temperature of drying are, of course important, since if one drys too fast the particles do not have an opportunity to fill up the pinholes. On the other hand, if one drys for too long of a period, the process time is increased which leads to lower process efficiency. The time and temperature of drying must be decided on a case by case basis, but the acceptability of any drying procedure is generally easily determined. For instance, drying will, of course, be sufficient to drive off the solvent but at a temperature insufficient to actually degrade any of the porous material, coating material or pinhole-filling material. Generally, an appropriate temperature is selected which ensures carrier liquid drive-off and no harm to the other components and then, after cutting a sample into several strips, different drying times are used until one which provides optimum results is reached. If a desired pinhole filling effect cannot be achieved, then the temperature is either raised or lowered, depending on whether the trend of the results indicate the temperature initially selected was too high or too low. Commonly used temperatures are about 60° to about 120° C. In the present invention, the pressure of treatment is unimportant and, for practical purposes, will always be atmospheric pressure. The temperature of treatment is also unimportant, so long as, of course, the particulate nature of the finally dispersed particles is not altered prior to the coagulating effect desired. When thermoplastic resin particles are used as the finely dispersed particles, the treated surface may be passed between heated calender rolls after drying so that the particles are fused and more complete sealing of pinholes is obtained. Due to the complicated nature of pinhole filling dispersion which depend on an exotic chemical reaction to perform their pinhole filling function, the general rule in the process of the present invention is that the "coagulation" or setting of the particles in the pinholes is accomplished by the drying step itself, i.e., carrier liquid removal. The results obtainable by such a simple procedure are excellent, and little need exists to go to complicated intrapinhole filling particle reactions. Obviously, a pinhole-filling substance such as titanium dioxide is not coagulated, but with the drying such particles are firmly set into the layer treated.

It is very convenient in this instance to use as the pinhole-filling dispersion one resembling the processing solution to be applied to the material during use, i.e., one which is similar in composition and viscosity to the processing solution to be applied to the material during practical use. For example, the liquid applied to the light-sensitive material at use is a liquid developer which is prepared by dispersing fine carbon black particles or the like of not more than 1 $\mu$ in particle size in a non-polar carrier liquid having a low viscosity and a low surface tension. Therefore, it is desirable to utilize as the pinhole-filling liquid a liquid having a similar surface tension to that of the liquid developer. Also, the dispersed particles are preferably about 1 $\mu$ or less in particle size, and are preferably particles of colorless pigment or resin.

It is to be noted that generally the surface tension of aqueous pinhole-filling liquids is relatively high, and they will tend to fail to adequately penetrate into very small pinholes. Accordingly, the general rule is that aqueous pinhole-filling systems are to be avoided. In short, the mainpoint of the present invention lies in utilizing the phenomenon that when a filling liquid flows through pinholes fine particles contained therein are caught at the pinholes and agglomerate to plug or stop up the pinholes. Such a phenomenon is experienced in the familiar case of, e.g., filtering a precipitate in a chemical experiment in which case a filter paper becomes impassable in the course of filtration, though the precipitate passes through the filter paper during the first stage.

The merits of the method of the present invention are clear from the data given in the following Examples. For example, polyvinyl alcohol is applied in an amount of about 2 g/m² as an aqueous solution to one surface of a fine quality paper of about 100 g/m² in weight. The thus formed layer contains a number of pinholes and, when a liquid developer for electrophotography is applied thereto without the processing of the invention, there are observed 20 to 30 pinholes per 1 cm². In order to reduce the number of pinholes to several pinholes per 1 cm², it is necessary to again apply thereto polyvinyl alcohol in an amount of 2–3 g/m². On the other hand, when the method of the invention is applied to the surface containing 20 to 30 pinholes per 1 cm², there can be obtained an almost completely pinhole-free surface, almost without an increase in the coating amount, as confirmed by measurement. That is, the method of the invention enables one to greatly reduce materials cost and coating amount.

Additionally, it is of course effective to repeat the method of the present invention one or more times.

The composition of the pinhole-filling dispersion used in the method of the invention may be freely selected, depending upon the kind of porous material used.

There may be provided on the processed support an electroconductive layer, a photoconductive layer or any other layer(s) desired to form the electrophotographic recording material.

As the processes for providing the layers described above, any known process or material can be used. As examples of the photoconductive material, there are zinc oxide, titanium oxide, cadmium sulfide, cadmium sulfoselenide (CdS. Se) and those set forth in U.S. Pat. No. 3,121,006, and as examples of the binder of the photoconductive layer, there are silicon resins, alkyd resins, epoxide resins, vinyl polymer resins such as polyvinyl alcohol, polyalkyl acrylates, polyalkyl methacrylates, polystyrene and those set forth in U.S. Pat. No. 3,121,006. Further, film forming photoconductive resins, as heretofore described, can be used to produce photoconductive layers.

The present invention will now be illustrated in greater detail by several non-limiting examples of preferred embodiments of the present invention. The present invention is not limited by the examples in any way, however.

Unless otherwise indicated, all percentages in the examples are weight percentges, and all processings were at room temperature and at atmospheric pressure.

EXAMPLE 1

A 100 g/m² paper of fine quality was used as a base material, and a 15% aqueous solution of polyvinyl alcohol (degree of polymerization ca.700) was applied to the wire-side surface thereof in a dry amount of 2 g/m². After drying, it was cut into two pieces. A commercially available electrophotographic liquid developer (prepared by dispersing carbon black in a carrier liquid of isoparaffinic hydrocarbons, the particle size of the carbon black being considered to be about 0.1 micron of less) was poured onto the resin-coated surface of one piece, it was left for 10 seconds and then washed well with an isoparaffinic solvent. The whole wire-side surface was found to be dotted with black spots. The frequency of the spots was 22 to 25 per 1 cm².

Thereafter, a dispersion was prepared by dispersing a vinyl chloride/vinyl acetate copolymer (copolymerization ratio: 65 : 35; polymerization degree: about 260) as fine particles in kerosene based solvent in the following manner.

30 Grams of a long oil-type alkyd resin (Solid Beckosol 18, made by Japan Reichhold Chemicals, Inc.; containing 21% by weight phthalic acid anhydride, 70% by weight of linseed oil, based on 100% of non-volatile matter; acid value less than 9%; specific gravity from 1.02 to 1.03) and 10 g of vinyl chloride/vinyl acetate copolymer (Denka Lac 61, made by Electro Chemical Industry Co., Ltd.; 45% by weight toluene solution of vinyl chloride/vinyl acetate copolymer having a solution viscosity of 1800–2800 cps/ 25° C, the copolymer consisting of 35% by weight of vinyl chloride and 65% by weight of vinyl acetate, and having a polymerization degree of 260) were dissolved in 40 cc of acetone and added to 5 liters of kerosene while stirring and applying ultrasonic waves. The alkyd resin was soluble in the kerosene while the vinyl chloride/vinyl acetate copolymer was insoluble and dispersed as fine particles, whose particles size was considered to be not more than 1 micron.

The processed paper surface of the second piece was brought into contact with the resulting dispersion for 10 seconds and washed with pure kerosene. Spots were seen as in the case of the aforesaid developer due to the penetration of the liquid. The thus processed paper was dried at 70° C and passed between calender rolls. When the above-described developer was then poured thereon, it did not penetrate.

The paper processed with the method of the present invention as described above was used as the support of an electrophotographic material.

The electrophotographic material obtained was subjected to electrophotographic processing using the aforesaid developing solution. An excellent image without black spots was obtained.

EXAMPLE 2

A 50 g/m² office paper was used as a base material, and an aqueous coating solution prepared by mixing 20 parts of an electroconductive resin (ECR-34), made by Dow Chemical Co.; polyvinylbenzyltrimethyl ammonium chloride in water, containing about 30% non-volatile components) and 50 parts of a 10% aqueous solution of polyvinyl alcohol (degree of polymerization ca. 600) was applied to the felt-side surface thereof in a dry amount of 1.5 g/m². The sample was cut into two pieces.

When the same developer as in Example 1 was poured onto one piece, there were observed 50 to 60 black spots per 1 cm².

As the processing dispersion to remove pinholes, there was used an organic solvent dispersion of polyvinyl acetate. This processing solution was prepared as follows.

A first solution was prepared by dissolving 10 g of polyvinyl acetate (degree of polymerization ca. 550) in 100 cc of acetone. Separately, a second solution was prepared by adding to 200 ml of cyclohexane 20 ml of a 20% toluene solution of varnish obtained by thermally condensing a rosin-modified phenolformaldehyde resin and linseed oil. 10 cc of the first solution and 200 cc of the second solution were mixed with each other to prepare a processing dispersion.

When the resin-coated surface of the second piece was brought into contact with the resulting processing dispersion, the same spots as before were observed on the office paper. When the thus processed paper was dried at 60° C and the same developer as in Example 1 was poured thereon, no penetration of the developer took place. The finely dispersed substance had a size of less than 10 μ in the Example.

The paper processed with the method of the present invention as described above was used as the support of an electrophotographic material.

The electrophotographic material obtained was subjected to electrophotographic processing using the aforesaid developing solution. An excellent image without black spots was obtained.

EXAMPLE 3

A carbon black-containing original paper of 80 g/m² in weight was used as a base material, and an acetone solution of vinyl methyl ether/maleic anhydride copolymer (molecular ratio: 1:1, degree of polymerization ca.250) was applied thereto in a dry amount of 1.5 g/m². The sample was cut into two pieces. The thus processed surface contained a number of pinholes. Therefore, upon immersing in an isoparaffinic solvent (Isopar H C Esso Co., Ltd.; boiling range 174°–186° C; drying point 189° C, density 0.757, saturated hydrocarbon 99.3% aromatic hydrocarbons 0.2%, aniline point 83° C), random spots were produced due to the penetration of the solvent.

On the second piece of the thus coated copolymer surface there was poured a commercially available electrophotographic developer (developer for Elefax made by Iwasaki Communication Apparatus Co.; carbon black having alkyd resin adsorbed thereon carried in Isopar H) and, after standing for about 10 seconds, the surface washed with cyclohexane and dried at 80° C. When isoparaffinic solvent was poured on the thus treated surface the isoparaffins did not penetrate into the surface. The developer was self-fixing and contained as a toner the mixture of carbon black and the alkyd resin. The alkyd resin is considered to harden and stop up the pinholes.

EXAMPLE 4

5 Grams of gelatin for photographic use (bone gelatin) was weighed out and added to 95 ml of distilled water. The gelatin was swollen by allowing it to stand for 30 minutes and then dissolved by heating to 60° C while stirring. The thus obtained 5% by weight gelatin aqueous solution was coagulated by placing it in a refrigerator kept at 5° C. 10 Grams of the thus coagulated gelatin was charged into a ball mill together with 100 ml of acetone and milled for 10 hours. There was thus obtained a milky white acetone dispersion of gelatin. This acetone dispersion was subjected to centrifuging to collect the gelatin particles. Thereafter, 100 ml of fresh acetone was added to the gelatin particles and the gelatin particles further milled in a ball mill for 1 hour. This gelatin dispersion was again subjected to centrifuging to collect the gelatin particles, which were then washed with acetone. Thus, there was finally obtained 5 ml of an acetone paste containing gelatin particles.

To the resulting paste was added 5 ml of soybean oil, and the mixture was stirred and dispersed in 500 ml of acetone by ultrasonic waves.

A 50 g/m² thin paper of fine quality was used as a base material, and an electroconductive resin (Calgon Conductive Polymer 261, made by Calgon Corp.; poly (N,N-dimethyl-3,5-methylene piperidinium chloride) having the formula below; 1000 cps viscosity and a 1.085 specific gravity).

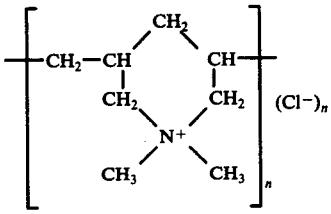

(wherein $n$ is a positive integer) was applied as an aqueous solution to wire-side surface thereof in an amount of 1 g/m². The thus processed surface possessed numerous pinholes through which xylol or toluol could pass.

A coating dispersion having the following composition was coated on the surface coated with Calgon Conductive Resin 261 (made by Calgon Corp.) at a coating amount of 25 g/m² (about 8 μ).

| Coating Solution | |
|---|---|
| Zinc Oxide (Sazex 2000 made by Sakai Kagaku) | 100 parts by weight |
| Silicon resin (KR-211, made by Shinetsu Chemical Industry Co., Ltd.) virnish | 40 parts by weight |
| Rose Bengal 1% methanol solution | 3 parts by weight |
| Toluene | 60 parts by weight |

The amount the dispersion was coated, the dispersion instantaneously penetrated into the substrate through the pinholes, therein and after drying many hillocks corresponding to the pinholes were observed on the coated surface (several tens of points/cm²).

When the above-described gelatin soybean oil-acetone, pinhole-filling liquid was applied to the Conductive Polymer 261 resin-coated surface, there was observed a penetration of the liquid over the entire surface in a spot-like form. When the same toluene coating solution as above was applied thereto after drying at 90° C for 15 minutes, no penetration of the solution was observed.

After both electrophotographic materials were dark-adapted, the materials were charged to −6000V and exposed, and then developed using dry magnetic brush development in which the developer was U-bix (Trade name of an electrophotographic Copier manufactured by Konishiroku Photo Industry Co., Ltd.)

The image quality obtained using the electrophotographic material which had pinholes was extremely poor due to the rough surface, namely, the optical image density was small and fogging was significant.

On the other hand, the electrophotographic material of the present invention provided a very sharp image, that is, the optical image density was large and fog was small.

| | $D_{MAX}$ | $D_{FOG}$ |
|---|---|---|
| Comparative Example | 0.9 ~ 1.1 | 0.4 |
| Present Invention | 1.7 ~ 1.8 | 0.2 |

The following should especially be noted. That is, since the pinhole portions comprising gelatin in the undercoat have high resistivity and the light-sensitive layer at these areas may have, for example, smaller surface electrostatic charges than the other areas, the image should have spots corresponding to the pinholes. However, as a result of experiments, such a phenomenon was not observed. The reason therefore may be that the sizes of the pinholes are so small as compared with the thickness of the layer that the spots are not observable and appear uniform.

In addition, it was found that to obtain a similar pinhole free surface by simply increasing the coating amount of Calgon 261 using the same paper substrate, a coating amount of 2.5 ~ 3.0 g/m² was necessary.

EXAMPLE 5

An aqueous solution containing 50 parts by weight of the potassium salt of polyvinyl benzene sulfonic acid and 50 parts by weight of polyvinyl alcohol was coated on two supports having a coating of polyvinyl alcohol on the rear surface of each support obtained in the same manner as described in Example 1 provide a dry coating amount of 2 g/m². One of the coatings of polyvinyl alcohol had been treated with the dispersion of the present invention described in Example 1.

A coating dispersion having the following composition was coated in the following manner on the coating containing the potassium salt of polyvinyl benzene sulfonic acid and polyvinyl alcohol to obtain a photoconductive layer.

| Coating Solution | |
|---|---|
| Photoconductive Zinc Oxide (Sazex 2000, manufactured by Sakai Kagaku) | 100 parts by weight |
| Styrene modified alkyd resin varnish (Styresol 4400, manufactured by Japan Reichhold Chemicals, Inc.,) | 16 parts by weight |
| Polyisocyanate compound varnish (Colonate L, made by Japan Polyurethane) | 6 parts by weight |
| Butyl acetate | 25 parts by weight |
| Toluene | 20 parts by weight |

The polyisocyanate compound varnish was added to a uniform mixture containing the other ingredients just before coating. The dry thickness of the coating was 19 g/m².

The coated layer was hardened at 50° C, and then subjected to electrophotographic processing.

There was no penetration of liquid developer from the rear surface of the electrophotographic material treated by the method of the present invention after liquid development, and thre was no residual odor of the carrier liquid of the developer after the material was allowed to stand in the air for 2 hours at room temperature. On the contrary, the electrophotographic material not treated by the method of the present invention still exhibited traces of the penetrated liquid in spot-like manner, and the residual odor of the carrier liquid was strong.

While the invention has been described in detail and with reference to specific embodiments thereof, it will be apparent to one skilled in the art that various changes and modifications can be made therein without departing from the spirit and scope thereof.

What is claimed is:

1. In a process for producing an electrophotographic light-sensitive material comprising coating a paper support with an electroconductive layer and a photoconductive layer on the opposite side of said electroconductive layer, and directly coating on said paper support at least one film-forming resin layer, wherein said film-forming resin layer can be said electroconductive layer, the improvement which comprises bringing at least one film-forming resin layer directly coated on the support into contact with a pinhole-filling dispersion comprising a volatile liquid and a finely dispersed substance selected from the group consisting of a white or black pigment, a plastic particle or a pigment coated with a plastic therein, said liquid easily penetrating into the interior of the paper support through pinholes in said film forming resin layer and carrying said finely dispersed substance into said pinholes, whereby said finely dispersed substance fills and seals said pinholes which permit the penetration of said liquid and which exist in the surface of said film-forming resin layer which is itself capable of substantially completely preventing penetration of said liquid into said paper support and wherein the rate of penetration of said pinhole-filling dispersion is from about $2 \times 10^{-4}$mm³ to about $60 \times 10^{-4}$mm³/second.

2. The method of claim 1 wherein prior to treatment with said pinhole-filling dispersion from 5 to 30 pinholes per cm² are present, and after said treatment with the pinhole-filling dispersion less than 5 pinholes per cm² are present.

3. The method of claim 2 where the pinholes have a diameter less than about 10 microns and the finely dispersed substance has a size equal to or less than the size of the pinholes.

4. The method of claim 3 wherein the size of the finely dispersed substance is from about 0.5 microns to about 5 microns.

5. The method of claim 1 wherein said film-forming resin is selected from the group consisting of a polyalkyl acrylate, a polymethacrylate, a copolymer of an alkylacrylate, a copolymer of an alkylmethacrylate, a linear polyester, an unsaturated polyester, an alkyd epoxy resin, a polyvinyl alcohol, polyvinylbenzyl trimethylammonium chloride or a copolymer of styrene and butadiene.

6. The method of claim 3 wherein said liquid carrying said finely dispersed substance therein is selected from the group consisting of one or more volatile petroleum hydrocarbons, esters, ketones, alcohols and halogenated hydrocarbons.

7. The method of claim 1 wherein said finely dispersed substance comprises from about 1 to 20% by volume of the said liquid.

8. The method of claim 1 wherein said liquid carrying said finely dispersed substance therein is contacted with said film-forming resin layer for about 2 seconds to about 40 seconds, after which drying is conducted.

9. The method of claim 8 wherein drying is at about 60° C to about 120° C.

10. The method of claim 1 wherein the finely dispersed substance is said white or black pigment.

11. The method of claim 1 wherein the finely dispersed substance is said plastic particle.

12. The method of claim 1 wherein the finely dispersed substance is said pigment coated with a plastic.

13. The method of claim 1 wherein said liquid is an organic liquid.

14. The method of claim 1 wherein the rate of penetration of said pinhole-filling dispersion is from $4 \times 10^{-4}$ to $32 \times 10^{-4}$mm³/sec.

15. In the process of claim 1, said film-forming resin layer is an electroconductive resin layer.

16. In the process of claim 1, said film-forming resin layer exists on the back side of the support bearing a photoconductive layer.

17. In the process of claim 1, said plastic is a thermoplastic resin and the resin layer after contacting with the dispersion is dried and passed between heated calender rolls thereby the plastic is fused.

18. In the process of claim 1, wherein excess pinhole-filling dispersion is removed after being brought into contact with said at least one film-forming layer.

19. In a process for producing an electrophotographic light-sensitive material having an electroconductive carbon black-containing paper support and at least one film-forming resin layer directly coated on the support comprising coating said support with a photoconductive layer, wherein said photoconductive layer can be said film-forming resin layer, the improvement which comprises bringing at least one film-forming resin layer directly coated on the carbon black-containing support into contact with a pinhole-filling dispersion comprising a volatile liquid and a finely dispersed substance selected from the group consisting of a white or black pigment, a plastic particle or a pigment coated with a plastic therein, said liquid easily penetrating into the interior of the porous paper support through pinholes in said film-forming resin layer and carrying said finely dispersed substance into said pinholes, whereby said finely dispersed substance fills and seals said pinholes which permit the penetration of said liquid and which exist in the surface of said film-forming resin layer which is itself capable of substantially completely preventine penetration of said liquid into said paper support and wherein the rate of penetration of said pinhole-filling dispersion is from about $2 \times 10^{-4} mm^3$ to about $60 \times 10^{-4} mm^3$/second.

20. In the process of claim 18, wherein the finely dispersed substance is said pigment coated with a plastic.

21. In the process of claim 19, wherein the film-forming resin layer is a vinyl methyl ether-maleic anhydride copolymer layer.

* * * * *